US009888770B1

(12) United States Patent
Chen

(10) Patent No.: US 9,888,770 B1
(45) Date of Patent: Feb. 13, 2018

(54) SHELF ASSEMBLY

(71) Applicant: Affinity Hardware Co., Ltd., Taipei (TW)

(72) Inventor: Chien-Fu Chen, Taipei (TW)

(73) Assignee: Affinity Hardware Co., Ltd., Taipei (TW)

( * ) Notice: Subject to any disclaimer, the term of this patent is extended or adjusted under 35 U.S.C. 154(b) by 0 days.

(21) Appl. No.: 15/656,172

(22) Filed: Jul. 21, 2017

(51) Int. Cl.

| | |
|---|---|
| ***A47B 47/00*** | (2006.01) |
| ***A47B 57/00*** | (2006.01) |
| ***A47B 96/06*** | (2006.01) |
| ***A47B 57/34*** | (2006.01) |
| ***A47B 57/40*** | (2006.01) |
| ***A47B 47/02*** | (2006.01) |

(52) U.S. Cl.
CPC ..... *A47B 57/34* (2013.01); *A47B 47/00* (2013.01); *A47B 47/0083* (2013.01); *A47B 47/02* (2013.01); *A47B 57/00* (2013.01); *A47B 57/40* (2013.01); *A47B 96/06* (2013.01)

(58) Field of Classification Search
CPC ... A47B 96/06; A47B 96/1441; A47B 47/021; A47B 47/027; A47B 47/0083; A47B 57/34; A47B 5/40; A47B 57/402
See application file for complete search history.

(56) References Cited

U.S. PATENT DOCUMENTS 1,401,041 A * 12/1921 Chipperfield ..... A47B 47/021 312/257.1
1,673,384 A * 6/1928 Woltz ..... A47B 96/06 108/185
2,527,253 A * 10/1950 Hedfield ..... A47B 96/06 248/235
2,937,767 A * 5/1960 Butler ..... A47B 47/021 211/187
3,195,735 A * 7/1965 Jay ..... A47B 57/402 211/182
3,439,812 A * 4/1969 Nagelkirk ..... F16B 12/20 108/108
4,224,776 A * 9/1980 Hammerschlag .... A47B 47/021 211/187
4,342,397 A * 8/1982 Halstrick ..... A47B 57/402 211/182

(Continued)

*Primary Examiner* — Daniel J Troy
*Assistant Examiner* — Kimberley S Wright
(74) *Attorney, Agent, or Firm* — Alan D. Kamrath; Kamrath IP Lawfirm, P.A.

(57) ABSTRACT

A shelf assembly includes four vertical posts each having vertically spaced first engaging holes and vertically spaced second engaging holes. Each of two horizontal beams includes a first board. Each end of each horizontal beam includes a third engaging groove and a first buckle having a first coupling groove. Each of two connecting beams includes a second board. Each end of the second board includes a second buckle having a second coupling groove. A support board is mounted on top of the horizontal beams and the connecting beams. Each first buckle engages one of the first engaging holes. Each second buckle extends through one of the third engaging holes and one of the second engaging holes. Each first coupling groove engages a bottom edge of one of the first engaging holes. Each second coupling groove securely receives a corresponding connecting wall and the first board of a corresponding horizontal beam.

11 Claims, 11 Drawing Sheets

(56) References Cited

U.S. PATENT DOCUMENTS

| | | | | |
|---|---|---|---|---|
| 4,796,541 | A * | 1/1989 | Halstrick | A47B 57/402 108/107 |
| 5,377,851 | A * | 1/1995 | Asano | A47B 47/022 211/191 |
| 6,019,331 | A * | 2/2000 | Hoogland | A47B 96/061 108/108 |
| 6,691,880 | B2 * | 2/2004 | Kostant | A47B 47/027 211/189 |
| 7,243,887 | B2 * | 7/2007 | Magnusson | A47B 96/024 248/235 |
| 8,899,162 | B2 * | 12/2014 | Chikkakalbalu | A47B 96/027 108/108 |
| 9,167,896 | B1 * | 10/2015 | Wu | A47B 96/1441 |
| 9,668,578 | B2 * | 6/2017 | Wilbs | A47B 96/1416 |
| 2003/0010740 | A1 * | 1/2003 | Konstant | A47B 47/027 211/189 |
| 2005/0045787 | A1 * | 3/2005 | Magnusson | A47B 96/024 248/235 |
| 2006/0243692 | A1 * | 11/2006 | Proffitt | A47B 57/48 211/187 |
| 2007/0062898 | A1 * | 3/2007 | Choi | A47B 57/408 211/192 |
| 2008/0224002 | A1 * | 9/2008 | Butow | A47B 96/06 248/205.1 |
| 2016/0029787 | A1 * | 2/2016 | Go | A47B 57/08 211/187 |
| 2016/0120305 | A1 * | 5/2016 | Kassanoff | A47B 47/0091 312/111 |

* cited by examiner

A - A

B - B

SHELF ASSEMBLY

BACKGROUND OF THE INVENTION

The present invention relates to a shelf assembly and, more particularly, to a shelf assembly capable for storing articles while providing enhanced assembling convenience and reliable support.

To improve article storage convenience, a type of shelf includes a plurality of vertical posts, a plurality of horizontal beams, and a plurality of support boards. Each vertical post includes a plurality of engaging holes at different heights. The horizontal beams are mounted to the vertical posts at suitable heights to form supports for the support boards. The number and the heights of the support boards can be adjusted according to need to increase the article storage applicability.

FIG. 10 shows a portion of a conventional shelf assembly including a plurality of vertical posts 1', a plurality of horizontal beams 2', and a support board 3'. Each of the vertical posts 1' and the horizontal beams 2' includes a plurality of engaging holes 11', 21'. Bolts 4' extend through engaging holes 11' and 21' in proper locations and are coupled with nuts 41' to assemble the vertical posts 1' and the horizontal beams 2' together. The support board 3' is placed on the vertical beams 1' and the horizontal beams 2' for supporting articles.

However, the assemblage requires extending the bolts 4' through the engaging holes 11' and 21' and coupling the bolts 4' with the nuts 41', resulting inconvenient assemblage. Furthermore, the shelf is apt to fall when the threading connection between the bolts 4' and the nuts 41' is not secure. Furthermore, the support board 3' rests on the vertical beams 1' and the horizontal beams 2' by its weight and is not securely positioned. Thus, the support board 3' is apt to displace and fall due to impact.

FIG. 11 shows another conventional shelf assembly for increasing the assembling convenience. This shelf assembly includes four vertical posts 5', four horizontal beams 6', and a support board 7'. Each vertical post 5' includes two connecting walls 51' and 52' extending perpendicularly to each other. Engaging holes 511', 521' are provided in each connecting wall 51', 52 at different heights. Each horizontal beam 6' includes an outer side having buckles 61' for coupling with the engaging holes 511' or 521'. Each horizontal beam 6' can be coupled with the engaging holes 511' and 521' in different directions to form a shelf assembly, and the support board 7' can be placed on top of the horizontal beams 6'.

The above shelf assembly can be easily assembled without bolts and nuts. However, the two connecting walls 51' and 52' of each vertical post 5' are respectively connected to two of the horizontal beams 6' which are not interconnected. As a result, the resultant shelf assembly has insufficient structural strength and is, thus, apt to deform when subjected to external forces.

BRIEF SUMMARY OF THE INVENTION

An objective of the present invention is to provide a shelf assembly providing enhanced assembling convenience and a secure structure.

A shelf assembly according to the present invention includes four vertical posts disposed in four corners of a square area. Each of the four vertical posts includes at least one connecting wall and a sidewall extending at a non-parallel angle to the at least one connecting wall. The at least one connecting wall includes a plurality of first engaging holes and a plurality of second engaging holes. The plurality of first engaging holes is spaced from each other in a vertical direction. The plurality of second engaging holes is spaced from each other in the vertical direction. Each of the plurality of first engaging holes is spaced from one of the plurality of second engaging holes in a length direction perpendicular to the vertical direction. Two horizontal beams are spaced from each other in a width direction perpendicular to the vertical direction and the length direction. Each of the two horizontal beams includes a first board including first and second ends spaced from each other in the length direction and respectively coupled with two of the four vertical posts spaced from each other in the length direction. Each of the first and second ends of each of the two horizontal beams includes a first buckle extending perpendicularly to and outwardly from the first board in the width direction and having a first coupling groove. Each of the first end and the second end of the first board of each of the two horizontal beams includes a third engaging hole. Two connecting beams are spaced from each other in the length direction. The two horizontal beams and the two connecting beams together form a rectangular structure. Each of the two connecting beams includes a second board having two ends. Each of the two ends of the second board includes a second buckle extending therefrom in the width direction. Each second buckle includes a bottom face having a second coupling groove. A support board has rectangular cross sections and is mounted on top of the two horizontal beams and the two connecting beams. Each first buckle of each of the two horizontal beams is engaged with one of the plurality of first engaging holes of a corresponding one of the four vertical posts. Each of the plurality of second engaging holes is aligned with one of the third engaging holes. Each second buckle of each of the two connecting beams extends through a corresponding one of the third engaging holes and a corresponding one of the plurality of second engaging holes. Each first coupling groove of each of the two horizontal beams is engaged with a bottom edge of the one of the plurality of first engaging holes. Each second coupling groove securely receives the at least one connecting wall of one of the four vertical posts and the first board of one of the two horizontal beams.

In an example, the first board of each of the two horizontal beams includes a first ledge extending perpendicularly to and inwardly from an upper end of the first board, and the support board rests on the first ledges of the two horizontal beams.

In an example, the first ledge of each of the two horizontal beams includes a plurality of positioning protrusions. The support board includes a bottom side having a plurality of positioning grooves. The plurality of positioning protrusions is received in the plurality of positioning grooves.

In an example, at least one of the plurality of positioning protrusions extends in the length direction, and the rest of the plurality of positioning protrusions extends in the width direction.

In an example, the plurality of first engaging holes is located outward of the plurality of second engaging holes. Each of the two horizontal beams includes a first stopper plate extending perpendicularly to and outwardly from a lower end of the first board thereof. A spacing between each of two ends of the first stopper plate and a corresponding one of the first and second ends of the corresponding first board corresponds to a spacing between each of the plurality of first engaging holes of a corresponding one of the four vertical posts and an inner edge of the at least one connecting wall. An end face of each of the two ends of each first stopper plate abuts the sidewall of a corresponding one of the four vertical posts.

In an example, the second coupling groove of each second buckle has a width corresponding to the sum of a thickness of the at least one connecting wall of a corresponding one of the four vertical posts and a thickness of the first board of a corresponding one of the two horizontal beams. Each second coupling groove includes an inclined guiding surface at a lower end thereof.

In an example, each of the two connecting beams includes a second ledge extending inwardly from an upper end of the second board thereof. The support board rests on the second ledges of the two connecting beams. A spacing between each of two ends of each second ledge and a corresponding one of the two ends of a corresponding one of the second boards approximates a width of the first ledge of each of the two horizontal beams.

In an example, the plurality of first engaging holes is located outward of the plurality of second engaging holes. Each of the two connecting beams includes a second stopper plate extending inwardly from a lower end of the second board thereof. An end face of each of two ends of each second stopper plate abuts the first board of a corresponding one of the two horizontal beams.

In an example, each of the two horizontal beams includes another first buckle spaced from the first buckle in the vertical direction. The first buckle and the another first buckle respectively engage with two of the plurality of first engaging holes. Each of the first end and the second end of each first board further includes another third engaging hole spaced from the third engaging hole in the vertical direction. Each of the two connecting beams further includes another second buckle. The second buckle and the another second buckle of each of the two connecting beams respectively extend through two of the plurality of second engaging holes.

In an example, the shelf assembly further includes another two horizontal beams, another two connecting beams, and another support board. The two horizontal beams, the two connecting beams, and the support board are mounted to upper ends of the four vertical posts. The another two horizontal beams, the another two connecting beams, and the another support board are mounted to lower ends of the four vertical posts.

In an example, the shelf assembly further includes at least two additional vertical posts, a plurality of additional horizontal beams, a plurality of additional connecting beams, and a plurality of additional support boards. The four vertical posts, the at least two additional vertical posts, the two horizontal beams, the plurality of additional horizontal beams, the two connecting beams, and the plurality of additional connecting beams, the support board, and the plurality of additional support boards are assembled with each other to form a shelf assembly with a larger volume.

The present invention will become clearer in light of the following detailed description of illustrative embodiments of this invention described in connection with the drawings.

DESCRIPTION OF THE DRAWINGS

FIG. 1A is an enlarged view of a circled portion of FIG. 1.

FIG. 1B is an enlarged view of another circled portion of FIG. 1.

DETAILED DESCRIPTION OF THE INVENTION

Figure 1:
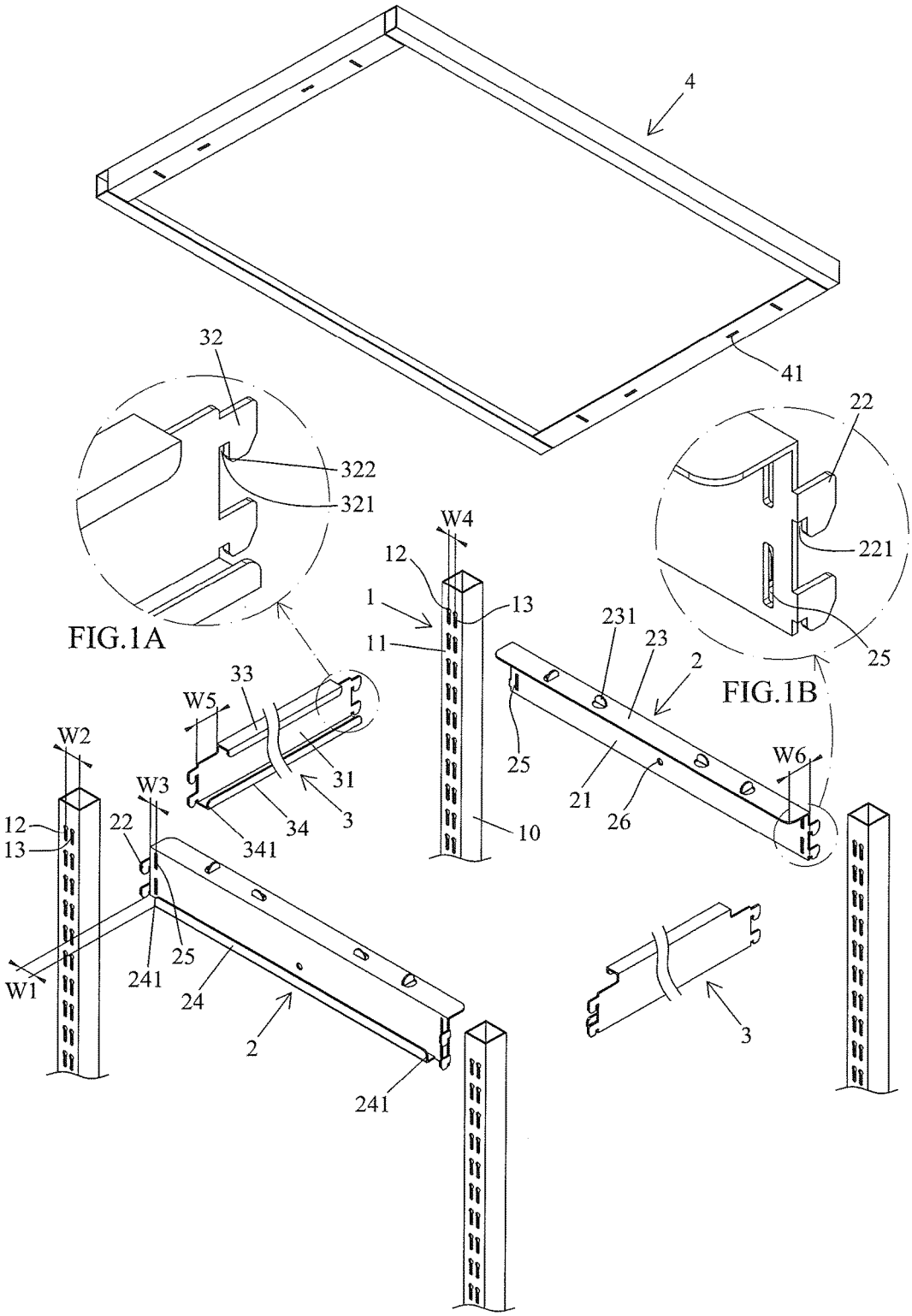
FIG. 1 is an exploded, perspective view of a shelf assembly of an example according to the present invention.
Figure 2:
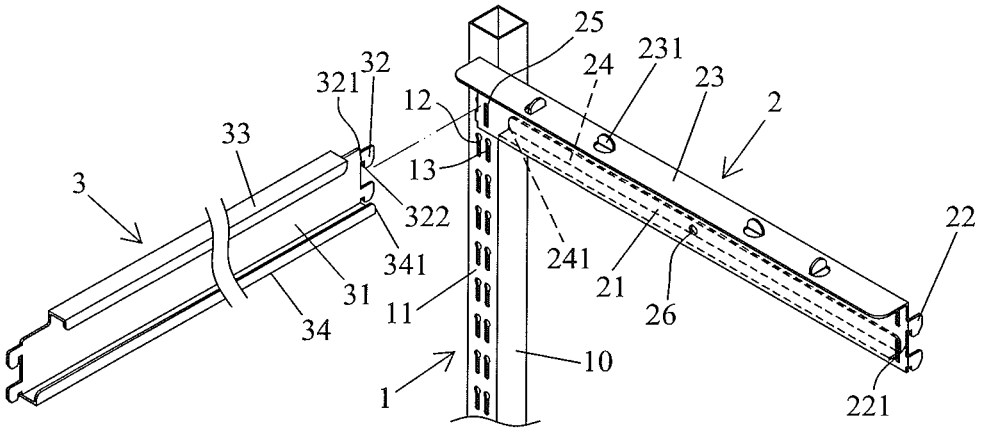
FIG. 2 is a partly-exploded perspective view of a portion of the shelf assembly according to the present invention.

With reference to FIGS. 1-7, a shelf assembly of an example according to the present invention includes four vertical posts 1, two horizontal beams 2, two connecting beams 3, and a support board 4. The four vertical posts 1 are disposed in four corners of a square area. Each vertical post 1 has an inner side adjacent to the square area and an outer side remote to the square area. Each vertical post 1 is a hollow tube and includes two connecting walls 11 opposite to each other and two sidewalls 10 extending between and at a non-parallel angle to the two connecting walls 11. Each connecting wall 11 includes a plurality of first engaging holes 12 and a plurality of second engaging holes 13. The first engaging holes 12 are spaced from each other in a vertical direction. The second engaging holes 13 are spaced from each other in the vertical direction. Each first engaging hole 12 is spaced from one of the second engaging holes 13 in a length direction perpendicular to the vertical direction. In this example, the first engaging holes 12 are located outward of the second engaging holes 13. Each vertical post 1 can include only one connecting wall 11 and only one sidewall 10.

The two horizontal beams 2 are elongated and are spaced from each other in a width direction perpendicular to the vertical direction and the length direction. Each horizontal beam 2 includes a first board 21 having first and second ends spaced from each other in the length direction and respectively coupled with two of the four vertical posts 2 spaced from each other in the length direction. Each of the first and second ends of each of first board 21 includes two first buckles 22 spaced from each other in the vertical direction and detachably coupled with two of the first engaging holes 12. Each first buckle 22 extends outwardly from and perpendicularly to the first board 21 in the width direction and has a bottom side a first coupling groove 221 for coupling with a bottom edge of one of the first engaging holes 12 of a corresponding vertical post 1.

Each horizontal beam 2 includes a first ledge 23 extending perpendicularly to and inwardly from an upper end of the first board 21 thereof. The first ledge 23 of each horizontal beam 2 includes a plurality of positioning protrusions 231. At least one of the positioning protrusions 231 extends in the length direction, and the rest of the positioning protrusions 231 extend in the width direction.

Each horizontal beam 2 further includes a first stopper plate 24 extending perpendicularly to and outwardly from a lower end of the first board 21 thereof. A spacing W1 between each of two ends of the first stopper plate 24 and a corresponding one of the first and second ends of the corresponding first board 21 corresponds to a spacing W2 between each first engaging hole 12 of a corresponding one of the four vertical posts 1 and an inner edge of the corresponding connecting wall 11. An end face 241 of each of the two ends of each first stopper plate 24 abuts a corresponding sidewall 10 of a corresponding one of the four vertical posts 1.

Each of the first end and the second end of the first board 21 of each horizontal beam 2 includes two third engaging holes 25 spaced from each other in the vertical direction. A spacing W3 between each third engaging hole 25 and a corresponding first buckle 22 approximates a spacing W4 between each first engaging hole 12 and a corresponding second engaging hole 13. Each first board 21 can include a coupling hole 26 for coupling with a rod 5 (see FIG. 8).

The two connecting beam 3 are spaced from each other in the length direction and are coupled with two of the four vertical posts 1 spaced from each other in the width direction. The two horizontal beams 2 and the two connecting beams 3 together form a rectangular structure. Each connecting beam 3 is elongated and includes a second board 31 having two ends. Each of the two ends of the second board 31 includes two second buckles 32 extending therefrom in the width direction. The two second buckles 32 are spaced from each other in the vertical direction. Each second buckle 32 includes a bottom face having a second coupling groove 321. The second coupling groove 321 of each second buckle 32 has a width corresponding to the sum of the thickness of a corresponding connecting wall 11 of a corresponding vertical post 1 and the thickness of the first board 21 of a corresponding horizontal beam 2. Each second coupling groove 321 includes an inclined guiding surface 322 at a lower end thereof.

Each connecting beam 3 includes a second ledge 33 extending inwardly from an upper end of the second board 31 thereof. A spacing W5 between each of two ends of each second ledge 33 and a corresponding one of the two ends of a corresponding second board 32 approximates a width W6 of the first ledge 23 of each horizontal beam 2. Each connecting beam 3 includes a second stopper plate 34 extending inwardly from a lower end of the second board 31 thereof. An end face 341 of each of two ends of each second stopper plate 34 abuts the first board 21 of a corresponding horizontal beam 2.

The support board 4 is has rectangular cross sections and rests on the first ledges 23 of the two horizontal beams 2 and the second ledges 33 of the two connecting beams 3. The support board 4 includes a bottom side having a plurality of positioning grooves 41 for engaging with the positioning protrusions 231.

Figure 3:
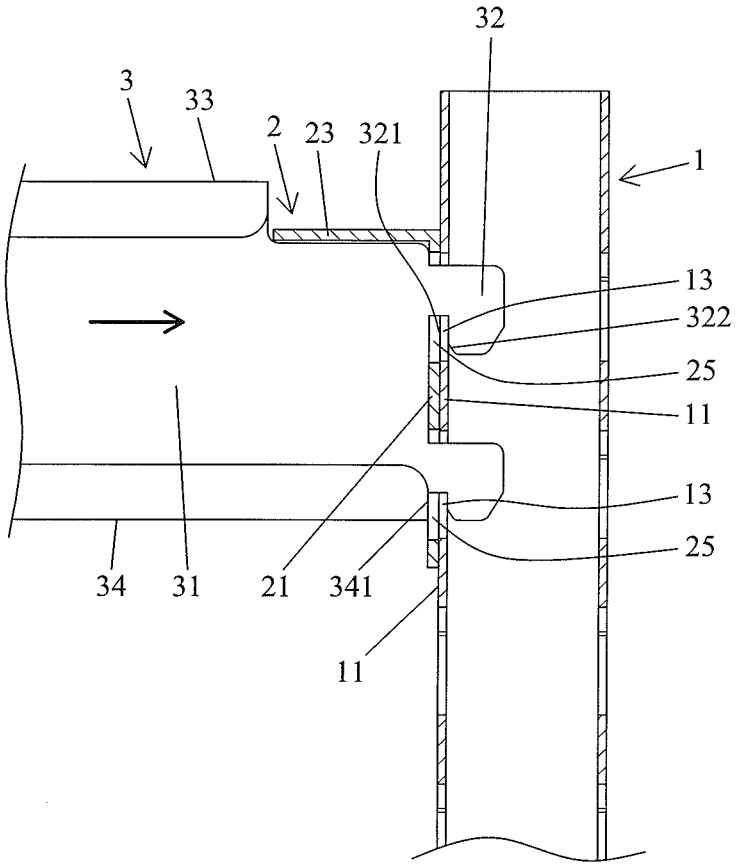
FIG. 3 is a cross sectional view of the portion of the shelf assembly of FIG. 2 after coupling.

In assembly, the four vertical posts 1 are located in four corners of the square area. The two horizontal beams 2 are mounted in opposite locations. Each first buckle 22 of each horizontal beam 2 is engaged with one of the first engaging holes 12 of a corresponding vertical post 1. Each second engaging hole 13 is aligned with one of the third engaging holes 25, as shown in FIG. 3. Each first coupling groove 221 of each horizontal beam 2 is engaged with a bottom edge of a corresponding first engaging hole 12.

Figure 4:
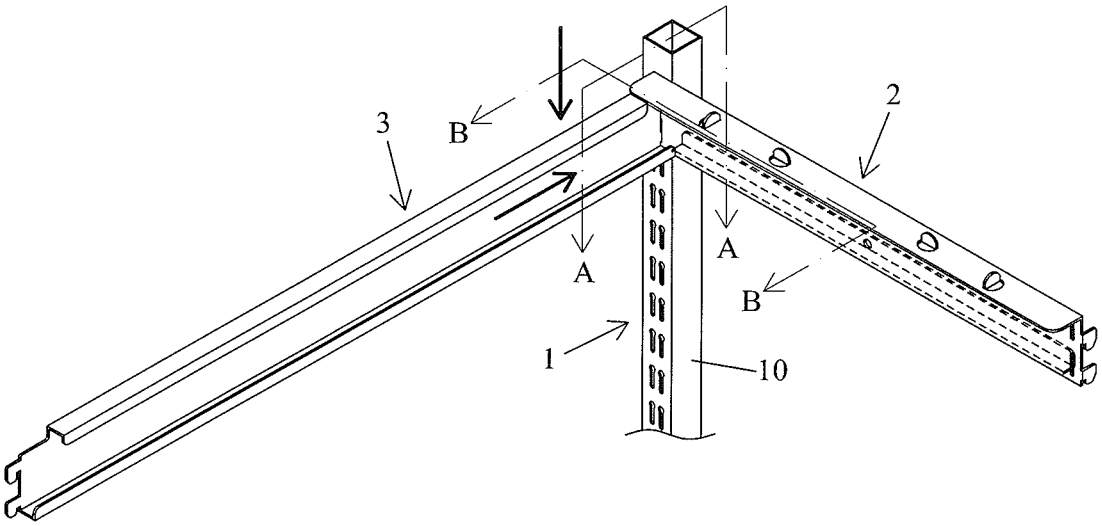
FIG. 4 is a perspective view of the portion of the shelf assembly of FIG. 2 after coupling.
Figure 5:
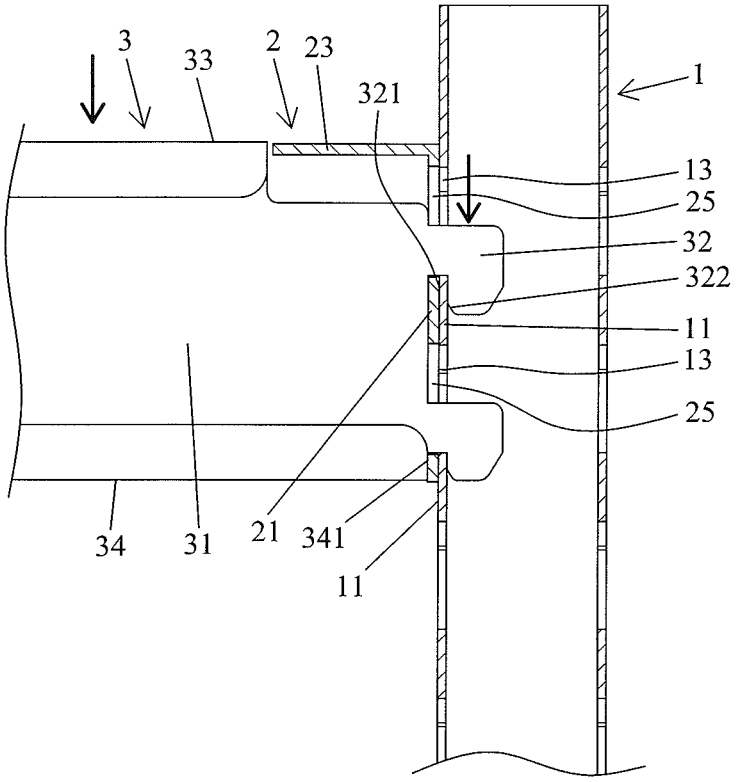
FIG. 5 is a cross sectional view taken along section line A-A of FIG. 4.
Figure 6:
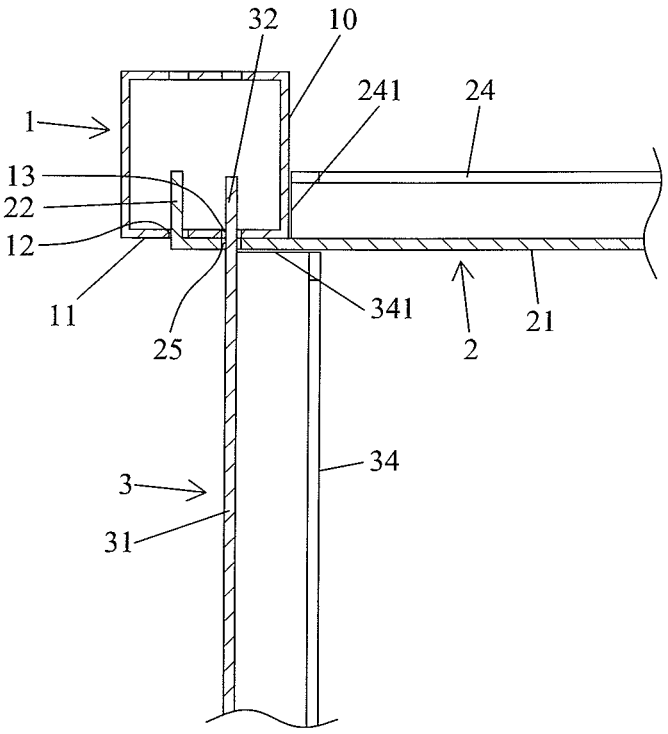
FIG. 6 is a cross sectional view taken along section line B-B of FIG. 4.
Figure 7:
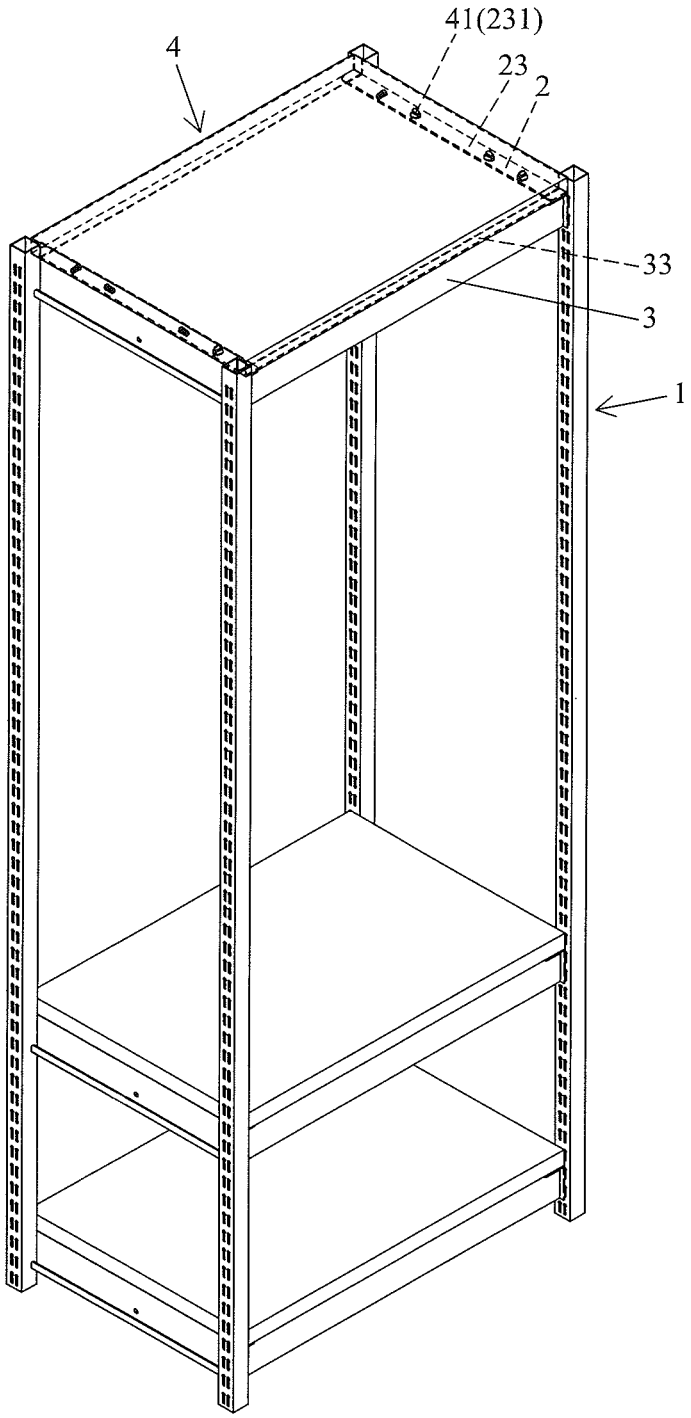
FIG. 7 is a perspective view of the shelf assembly of an example according to the present invention after assemblage.

The two connecting beams 3 are mounted in opposite locations. Each second buckle 32 of each connecting beam 3 extends through a corresponding third engaging hole 25 and a corresponding second engaging hole 13 (see FIG. 3). With reference to FIGS. 4-6, each connecting beam 3 is pressed downward, such that each second coupling groove 321 securely receives a corresponding connecting wall 11 of a corresponding vertical post 1 and the first board 21 of a corresponding horizontal beam 2. The inclined guiding surface 322 of each second coupling groove 321 provides a larger opening in the lower end of the second coupling groove 321 to permit easy downward movement of the second coupling groove 321 for coupling with the connecting wall 11 and the first board 21.

The horizontal beams 2, the connecting beams 3, and the vertical posts 1 are connected to each other to provide a three-dimensional structure with a better coupling effect and a better supporting effect. The first ledges 23 and the first stopper plates 24 at the upper and lower ends of the horizontal beams 2 increase the anti-torsional effect and the anti-bending effect of the horizontal beams 2. Furthermore, each end face 241 of each first stopper plate 24 abuts the corresponding sidewall 10 of the corresponding connecting wall 11 of the corresponding vertical post 1, as shown in FIG. 6. Furthermore, the second ledges 33 and the second stopper plates 34 at the upper end lower ends of the connecting beams 3 increase the anti-torsional effect and the anti-bending effect of the connecting beams 3. Furthermore, each end face 341 of each second stopper plate 34 abuts the corresponding first board 21 of the corresponding horizontal beam 2, as shown in FIG. 6. Thus, the anti-torsion effect of the whole frame assembly can be increased. Furthermore, the support board 4 rest on top of the first ledges 23 of the horizontal beams 2 and the second ledges 33 of the connecting beams 3, and the positioning grooves 41 of the support board 4 engage with the positioning protrusions 231 extending in different directions to reliably mount the support board 4 on top of the horizontal beams 2 and the connecting beams 3. Thus, the support board 4 serves as a reinforcing member to increase the assembling strength of the whole shelf assembly. Furthermore, the shelf assembly according to the present invention can be assembled without bolts while providing a better coupling effect and a better supporting effect.

In an example, two horizontal beams 2, two connecting beams 3, and a support board 4 are mounted to upper ends of the four vertical posts 1. Furthermore, another two horizontal beams 2, another two connecting beams 3, and another support board 4 are mounted to lower ends of the four vertical posts 1. Thus, the assembling strength of the shelf assembly is further enhanced. In an example shown in FIG. 7, another two horizontal beams 2, another two connecting beams 3, and another support board 4 are mounted at middle portions of the four vertical posts 1. Thus, the number and the heights of the mounting locations of the horizontal beams 2, the connecting beams 3, and the support boards 4 can be varied according to needs while increasing the assembling strength and the article storage convenience.

Figure 8:
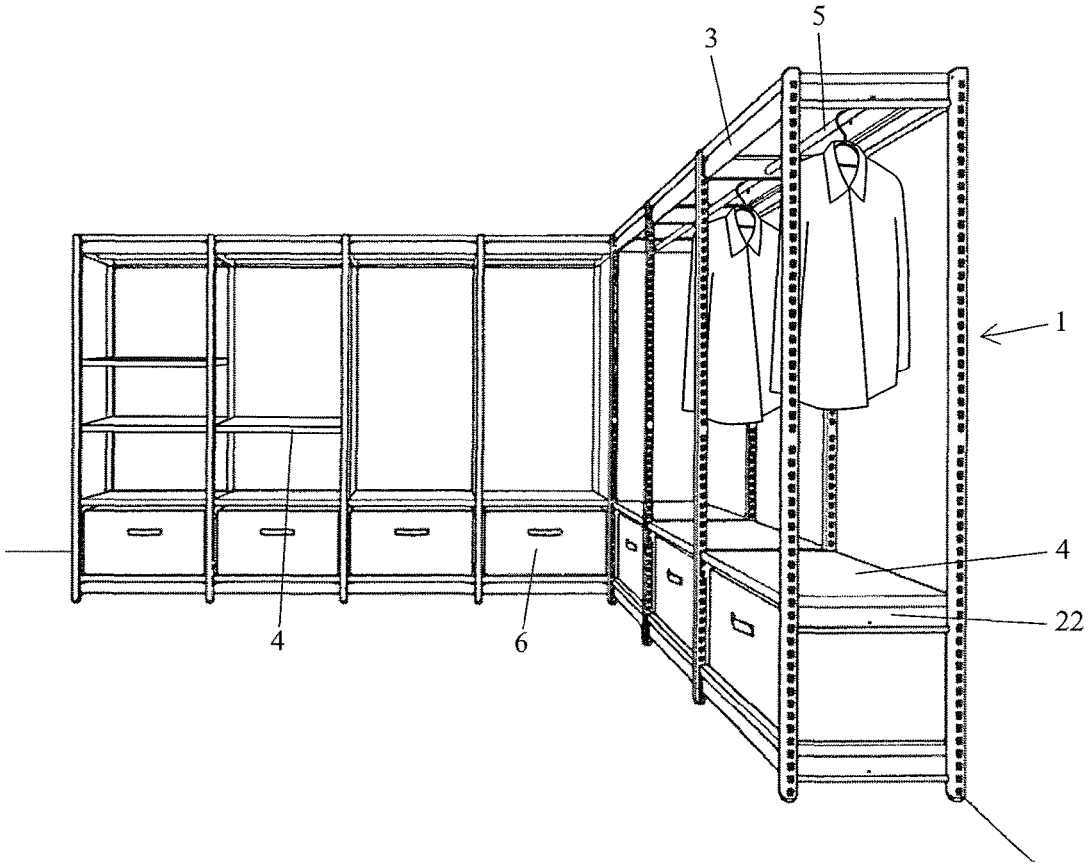
FIG. 8 is a perspective view of a shelf assembly of another example according to the present invention.
Figure 9:
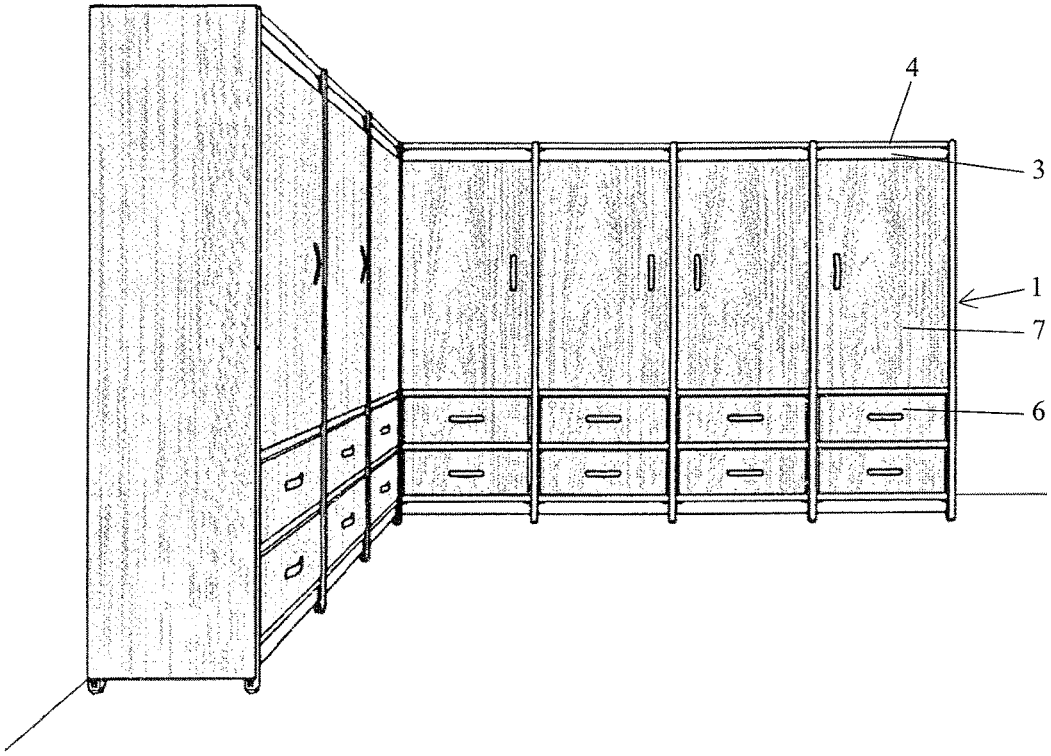
FIG. 9 is a perspective view of a shelf assembly of a further example according to the present invention.
Figure 10:
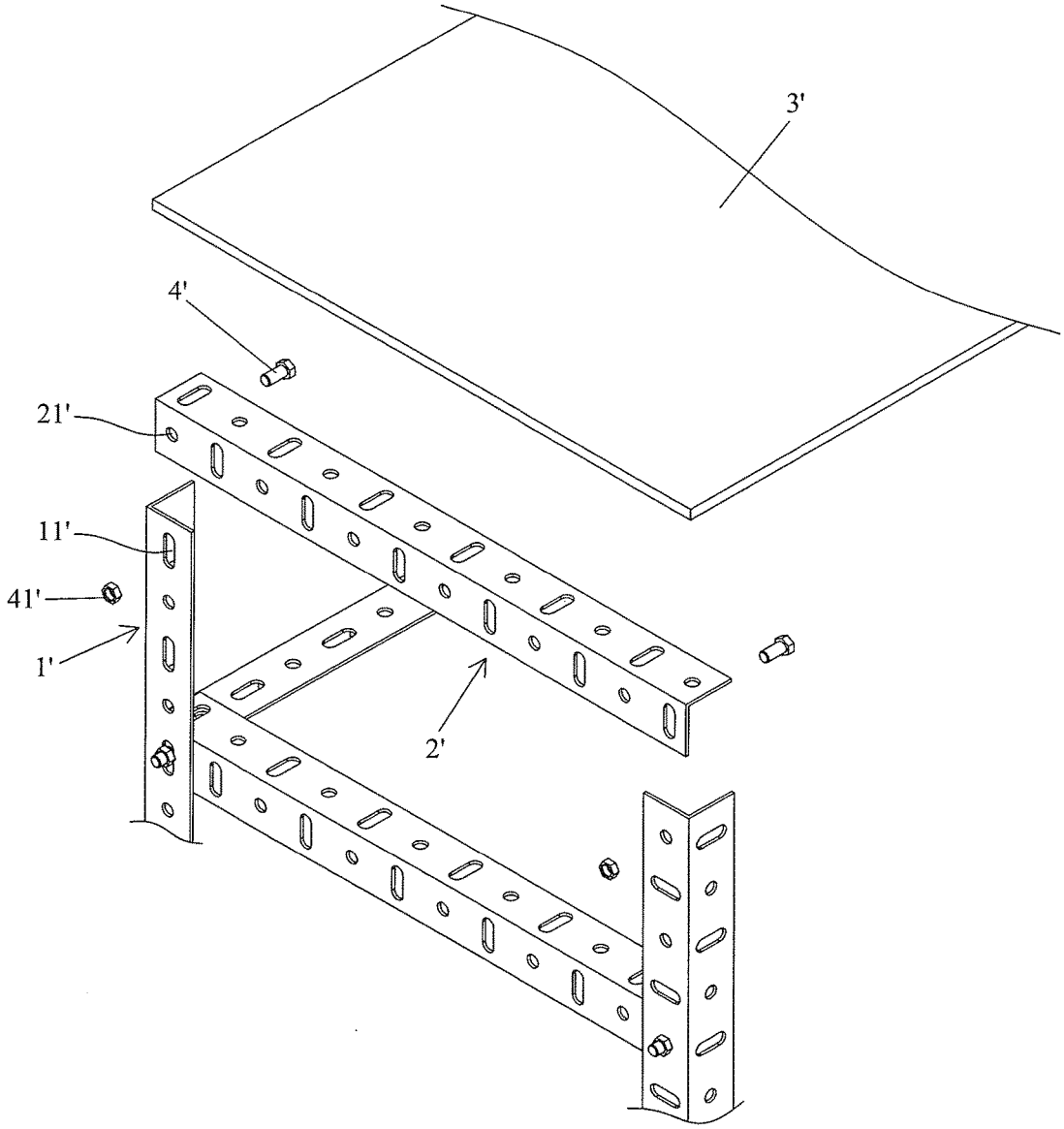
PRIOR ART F I G . 10
FIG. 10 is a partial, perspective view of a conventional shelf assembly.
Figure 11:
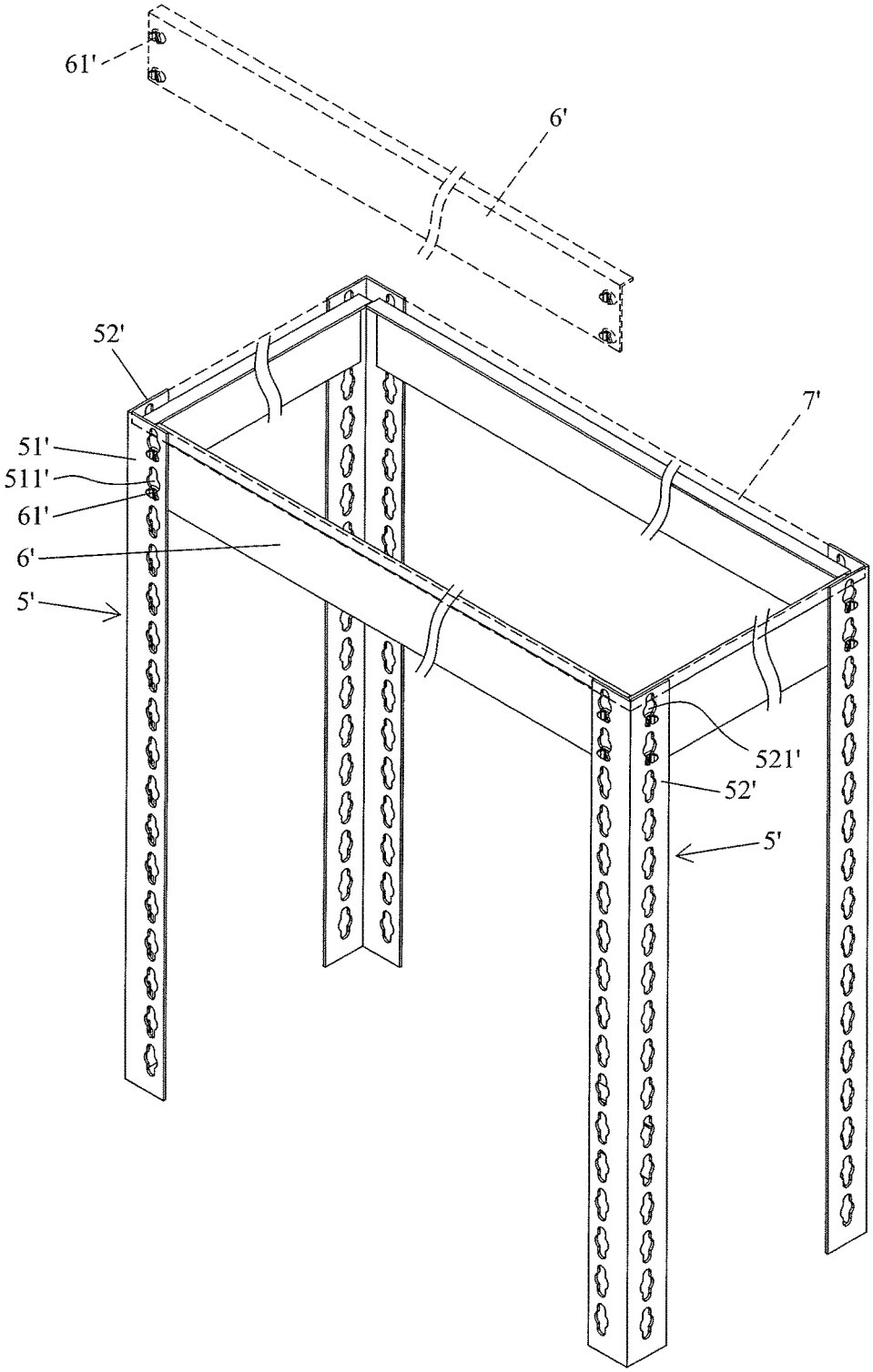
PRIOR ART F I G . 11
FIG. 11 is a partial, perspective view of another conventional shelf assembly.

With reference to FIGS. 8 and 9, six or more vertical posts can be assembled to form a shelf assembly having a larger volume. Furthermore, a rod 5 can be disposed between two horizontal beams 2 for hanging clothes. Furthermore, drawers 6 can be disposed in the shelf assembly. Furthermore, shielding boards 7 can be disposed to outer sides of the shelf assembly to form a closed closet. Thus, the present invention provides a better combination effect and better applicability.

In view of the foregoing, the present invention increases the convenience, stability, and security while assembling the shelf assembly. Furthermore, the vertical posts 1 can be of a multi-section design and can be coupled in the vertical direction or in other combination arrangements. Furthermore, the vertical posts 1 can be dismantled to reduce the volume.

Although specific embodiments have been illustrated and described, numerous modifications and variations are still possible without departing from the scope of the invention. The scope of the invention is limited by the accompanying claims.

The invention claimed is:

1. A shelf assembly comprising:

four vertical posts disposed in four corners of a square area, wherein each of the four vertical posts includes at least one connecting wall and a sidewall extending at a non-parallel angle to the at least one connecting wall, wherein the at least one connecting wall includes a plurality of first engaging holes and a plurality of second engaging holes, wherein the plurality of first engaging holes are spaced from each other in a vertical direction, wherein the plurality of second engaging holes are spaced from each other in the vertical direction, wherein each of the plurality of first engaging holes is spaced from one of the plurality of second engaging holes in a length direction perpendicular to the vertical direction;

two horizontal beams spaced from each other in a width direction perpendicular to the vertical direction and the length direction, wherein each of the two horizontal beams includes a first board including first and second ends spaced from each other in the length direction and respectively coupled with two of the four vertical posts spaced from each other in the length direction, wherein each of the first and second ends of each of the two horizontal beams includes a first buckle extending perpendicularly to and outwardly from the first board in the width direction and having a first coupling groove, and wherein each of the first end and the second end of the first board of each of the two horizontal beams includes a third engaging hole;

two connecting beams spaced from each other in the length direction, wherein the two horizontal beams and the two connecting beams together form a rectangular structure, wherein each of the two connecting beams includes a second board having two ends, wherein each of the two ends of the second board includes a second buckle extending therefrom in the width direction, wherein each second buckle includes a bottom face having a second coupling groove; and a support board, wherein the support board has rectangular cross sections and is mounted on top of the two horizontal beams and the two connecting beams, wherein each first buckle of each of the two horizontal beams is engaged with one of the plurality of first engaging holes of a corresponding one of the four vertical posts, wherein each of the plurality of second engaging holes is aligned with one of the third engaging holes, wherein each second buckle of each of the two connecting beams extends through a corresponding one of the third engaging holes and a corresponding one of the plurality of second engaging holes, wherein each first coupling groove of each of the two horizontal beams is engaged with a bottom edge of the one of the plurality of first engaging holes, and wherein each second coupling groove securely receives the at least one connecting wall of one of the four vertical posts and the first board of one of the two horizontal beams.

2. The shelf assembly as claimed in claim 1, wherein the first board of each of the two horizontal beams includes a first ledge extending perpendicularly to and inwardly from an upper end of the first board, and wherein the support board rests on the first ledges of the two horizontal beams.

3. The shelf assembly as claimed in claim 2, wherein the first ledge of each of the two horizontal beams includes a plurality of positioning protrusions, wherein the support board includes a bottom side having a plurality of positioning grooves, and wherein the plurality of positioning protrusions is received in the plurality of positioning grooves.

4. The shelf assembly as claimed in claim 3, wherein at least one of the plurality of positioning protrusions extends in the length direction, and wherein the rest of the plurality of positioning protrusions extends in the width direction.

5. The shelf assembly as claimed in claim 1, wherein the plurality of first engaging holes is located outward of the plurality of second engaging holes, wherein each of the two horizontal beams includes a first stopper plate extending perpendicularly to and outwardly from a lower end of the first board thereof, wherein a spacing between each of two ends of the first stopper plate and a corresponding one of the first and second ends of the corresponding first board corresponds to a spacing between each of the plurality of first engaging holes of a corresponding one of the four vertical posts and an inner edge of the at least one connecting wall, and wherein an end face of each of the two ends of each first stopper plate abuts the sidewall of a corresponding one of the four vertical posts.

6. The shelf assembly as claimed in claim 1, wherein the second coupling groove of each second buckle has a width corresponding to a sum of a thickness of the at least one connecting wall of a corresponding one of the four vertical posts and a thickness of the first board of a corresponding one of the two horizontal beams, and wherein each second coupling groove includes an inclined guiding surface at a lower end thereof.

7. The shelf assembly as claimed in claim 1, wherein each of the two connecting beams includes a second ledge extending inwardly from an upper end of the second board thereof, wherein the support board rests on the second ledges of the two connecting beams, and wherein a spacing between each of two ends of each second ledge and a corresponding one of the two ends of a corresponding one of the second boards approximates a width of the first ledge of each of the two horizontal beams.

8. The shelf assembly as claimed in claim 1, wherein the plurality of first engaging holes is located outward of the plurality of second engaging holes, wherein each of the two connecting beams includes a second stopper plate extending inwardly from a lower end of the second board thereof, and wherein an end face of each of two ends of each second stopper plate abuts the first board of a corresponding one of the two horizontal beams.

9. The shelf assembly as claimed in claim 1, wherein each of the two horizontal beams includes another first buckle spaced from the first buckle in the vertical direction, wherein the first buckle and the another first buckle respectively engage with two of the plurality of first engaging holes, wherein each of the first end and the second end of each first board further includes another third engaging hole spaced from the third engaging hole in the vertical direction, wherein each of the two connecting beams further includes another second buckle, and wherein the second buckle and the another second buckle of each of the two connecting beams respectively extend through two of the plurality of second engaging holes.

10. The shelf assembly as claimed in claim 1, further comprising another two horizontal beams, another two connecting beams, and another support board, wherein the two horizontal beams, the two connecting beams, and the support board are mounted to upper ends of the four vertical posts, and wherein the another two horizontal beams, the another two connecting beams, and the another support board are mounted to lower ends of the four vertical posts.

11. The shelf assembly as claimed in claim 1, further comprising at least two additional vertical posts, a plurality of additional horizontal beams, a plurality of additional connecting beams, and a plurality of additional support boards, wherein the four vertical posts, the at least two additional vertical posts, the two horizontal beams, the plurality of additional horizontal beams, the two connecting beams, and the plurality of additional connecting beams, the support board, and the plurality of additional support boards are assembled with each other to form a shelf assembly with a larger volume.

* * * * *